US005656083A

United States Patent [19]

Schönberger

[11] Patent Number: 5,656,083

[45] Date of Patent: Aug. 12, 1997

[54] CHAMBER DOCTOR

[75] Inventor: Wolfgang Schönberger, Neusäss, Germany

[73] Assignee: MAN Roland Druckmachinen AG, Offenbach am Main, Germany

[21] Appl. No.: 499,794

[22] Filed: Jul. 7, 1995

[30] Foreign Application Priority Data

Jul. 19, 1994 [DE] Germany ..... 44 25 478.4

[51] Int. Cl.[6] ..... B41F 31/06

[52] U.S. Cl. ..... 118/107; 118/413; 101/157; 101/363

[58] Field of Search ..... 118/413, 107, 118/108, 256; 101/363, 365, 154, 155, 156, 157, 167, 169

[56] References Cited

U.S. PATENT DOCUMENTS

| | | | |
|---|---|---|---|
| 2,655,102 | 10/1953 | Ross . | |
| 2,676,539 | 4/1954 | Behringer . | |
| 3,169,082 | 2/1965 | Krikorian | 118/413 |
| 3,273,535 | 9/1966 | Kridorian | 118/413 X |
| 5,345,867 | 9/1994 | Schneider et al. | 101/363 |
| 5,516,365 | 5/1996 | Sandberg et al. | 118/413 |

FOREIGN PATENT DOCUMENTS

| | | |
|---|---|---|
| 0294022 | 12/1988 | European Pat. Off. . |
| 1095296 | 12/1960 | Germany . |
| 4208295 | 9/1993 | Germany . |
| 4213660 | 11/1993 | Germany . |
| 522397 | 6/1940 | United Kingdom . |

*Primary Examiner*—Jeffrey Snay

*Attorney, Agent, or Firm*—Cohen, Pontani Lieberman & Pavane

[57] ABSTRACT

A device for inking a cylinder having depressions therein including a chamber doctor body to which a holder is pivotally connected, the holder being connected to a doctor blade. A force is applied to the holder causing the holder to pivot and force the doctor blade to contact the cylinder. The force may be adjustable aiding in compensating for wear of the doctor blade.

14 Claims, 1 Drawing Sheet

CHAMBER DOCTOR

BACKGROUND OF THE INVENTION

1. Field of the Invention

The present invention relates to chamber doctors and, more particularly, to a chamber doctor which is able to compensate for wear of a doctor blade.

2. Description of the Prior Art

Chamber doctors including doctor blades for wiping a cylinder to be inked are well known. The doctor blades are forced to contact the cylinder and thus are subject to wear. In order to increase the useful life of the chamber doctor the doctor blades must be readjusted to compensate for wear. A device which adjusts the working and closing doctor blades is described in German patent No. DE 42 13 660 A1. This patent discloses a chamber doctor having a working and closing doctor blade each displaceably disposed in a respective slot of the chamber doctor and pressed against the cylinder to be inked by springs to thereby readjust the doctor blades in accordance with wear on the blades. However, this device, due to the contract pressure forces and frictional forces between the tip of the doctor blade and the surface of the cylinder, applies a force vertical to the displacement direction of the doctor blade which results in frictional forces in the slot receiving the doctor blade thus inhibiting reliable readjustment of the doctor blade. Furthermore, due to its construction, ink is able to penetrate the slot receiving the doctor blade and accordingly reaches the large contact surface between the doctor blade and the blade holder causing the surface to become sticky when the ink dries. As a result of the dried ink frictional forces accumulate in an uneven manner having a negative influence on the contact pressure force of the doctor blade thus effecting the quality of wiping of the doctor blade.

SUMMARY OF THE INVENTION

It is thus an object of the present invention to provide a chamber doctor which will not negatively affect the constant contact pressure force of the doctor blade on the cylinder.

It is a further object of the present invention to provide a chamber doctor which prevents the movement of the doctor blade relative to its holder for the purpose of readjustment.

A still further object of the present invention is to provide a chamber doctor which allows only a small frictional moment in the bearing during pivoting of the holder to compensate for wear of the doctor blade.

The present invention is a device for inking a cylinder having depressions for receiving ink. The device includes a chamber doctor body having a holder pivotally connected thereto and a doctor blade connected to the holder. A force element applies a force to the holder causing it to pivot and thereby forcing the doctor blade to contact the cylinder. This force may be adjustable and thus the force at which the doctor blade contacts the cylinder can be adjusted to compensate for wear of the doctor blade.

Other objects and features of the present invention will become apparent from the following detailed description considered in conjunction with the accompanying drawings. It is to be understood, however, that the drawings are designed solely for the purposes of illustration and not as a definition of the limits of the invention, for which reference should be made to the appended claims.

DETAILED DESCRIPTION OF THE PRESENTLY PREFERRED EMBODIMENT

The present invention will now be described in more detail with reference to FIGS. 1 and 2.

Figure 1:
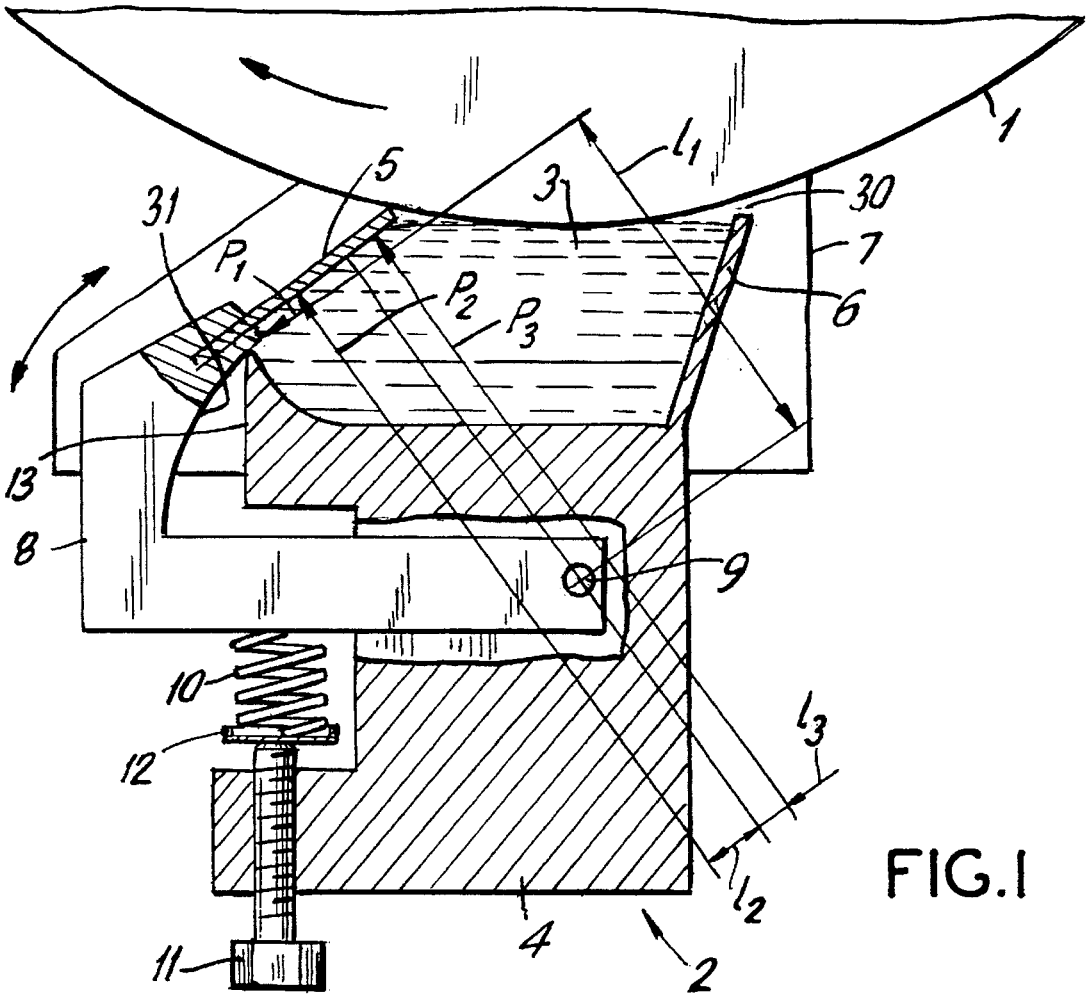
FIG. 1 is a cross-sectional view of a chamber doctor in accordance with the present invention.

FIG. 1 shows a chamber doctor 2 positioned for inking a cylinder 1 having depressions therein for receiving ink. The cylinder 1 may be a gravure form cylinder, a screening roller of a short inking mechanism or any other type of cylinder able to print an image on a web.

The chamber doctor 2 includes an ink chamber 3 defined by a chamber doctor body 4, a working doctor blade 5, a strip 6 and side walls 7. The side walls 7 are positioned on either side of the working doctor blade 5 contacting a respective edge thereof and also contacting the cylinder 1. The working doctor blade 5 is fastened in place by a holder 8 which is pivotally mounted to the chamber doctor body 4 by bearing pins 9. The strip 6 is positioned at a distance from the cylinder 1 providing a gap 30 therebetween.

A force element 10 acts on the holder 8 causing it to pivot about bearing pin 9 towards the cylinder 1 and forcing the working doctor blade 5 to contact the cylinder 1. The force element 10 may be in the form of a pressure spring as shown in FIG. 1, a working cylinder or electromagnet as shown in FIG. 2 and discussed hereinafter or any other device suitable for exerting an adjustable force on the holder 8 causing it to pivot and the doctor blade 5 to contact the cylinder 1.

The force exerted by the pressure spring 10 may be adjusted by a spindle 11 and support plate 12 combination. The spindle 11 is screwed into the chamber doctor body 4 and when adjusted, displaces the support plate 12 mounted thereon to vary the tension between the pressure spring 10 and the holder 8. The pressure spring 10 is positioned between the support plate 12 and the holder 8. Varying the tension of the pressure spring 10 acts to either limit or increase the pivotability of the holder 8 and thus also of the doctor blade 5 connected to the holder 8.

Compensation for wear of the working doctor blade 5 is automatically achieved as the pressure spring 10 pivots the holder 8 and the working doctor blade 5 towards or away from the cylinder 1 based upon the condition of the working doctor blade 5.

A gap of about 0.1 to about 1.0 mm is provided between a tapered edge 13 of the chamber doctor body 4 and the holder 8 to prevent frictional forces acting on the holder 8 as it pivots. Furthermore, the edge 31 of the plate holder 8 is advantageously curved in the region of the gap and sealing of the ink chamber 3 with the radius of the curve around its center of rotation to keep the gap at a constant width during pivoting of the holder 8. Since the gap is of such a small width it is not necessary to seal it as dried ink will not increase the frictional force. Any ink which escapes the ink chamber 3 will be collected by an ink fountain (not shown), this includes ink escaping through the gap 30 between the strip 6 and the cylinder 1. The strip 6 can also be replaced by a closing doctor blade which is able to contact and wipe off the cylinder 1.

Figure 2:
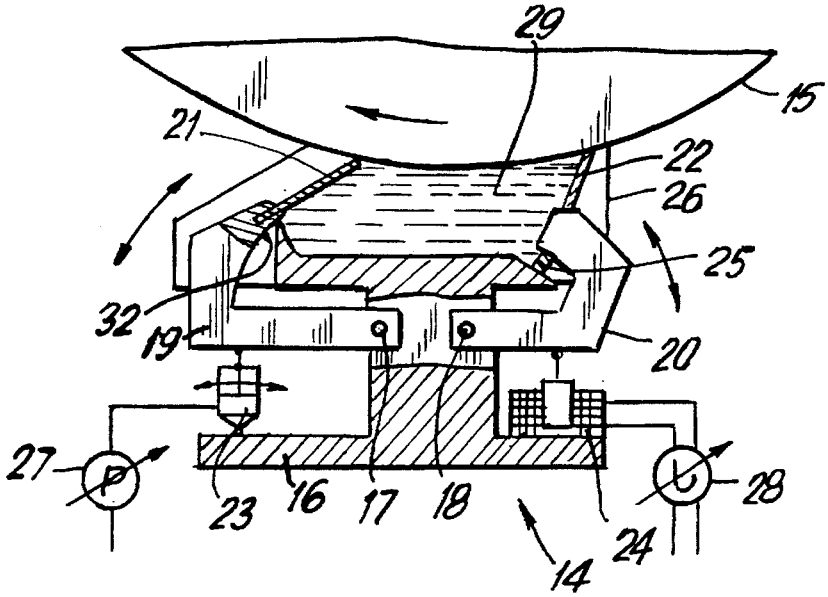
FIG. 2 is a cross-sectional view of a chamber doctor in accordance with the present invention showing an alternate type of force element from that of FIG. 1.

FIG. 2 shows an embodiment of the present invention using a closing doctor blade replacing the strip 6 in FIG. 1.

The chamber doctor 14 includes two holders 19, 20, each pivotally attached to the chamber doctor body 16 by a respective bearing pin 17, 18. Each holder 19, 20 has a doctor blade 21, 22, respectively, accommodated within a slot therein. This figure shows doctor blade 21 as a working doctor blade and doctor blade 22 as a closing doctor blade. The chamber doctor includes an ink chamber 29 for holding the ink to be applied to the cylinder 15 defined by the chamber doctor body 16, the working doctor blade 21, the closing doctor blade 22 and side walls 26. The side walls 26 are positioned on either side of and extending between the doctor blades 21, 22 contacting an edge of each doctor blade 21, 22. The doctor blades 21, 22 are adjustably held by their respective holders 19, 20 so as to contact the cylinder 15.

A working cylinder 23 is positioned in an articulated manner on the chamber doctor body 16 and to support and act on the holder 19 in an articulated or jointed manner. The working cylinder 23 is supplied with a pressure medium, i.e. a liquid or gas, and applies a force to the holder 19 based upon the supply of pressure thereto. The pressure of the medium can be adjusted through use of a pressure regulator 27 thereby adjusting the force at which the working doctor blade 21 contacts the cylinder 15 and compensating for wear on the part of the doctor blade 21.

An electromagnet 24 is positioned between the chamber doctor body 16 and the holder 20 and connected to the holder 20 in an articulated or jointed manner. A gap exists between the holder 20 and the chamber doctor body 16 and along the defining surface of the ink chamber 29. A seal 25 is worked into the chamber doctor body 16 at the point of the gap thereby allowing pivoting of the holder 20 without allowing ink to escape from the ink chamber 29.

The magnet 24 applies a force to the holder 20 causing the closing doctor blade 22 to contact the cylinder 15. The force at which the closing doctor blade 22 contacts the cylinder 15 is based upon the adjustable force applied by the magnet 24; this force may be adjusted by a voltage regulator 28. This doctor blade 22 is therefore readjusted in the event of wear by an automatic pivoting of the holder 20.

In operation the same force element, i.e. working cylinder, spring, electromagnet, etc., is normally used for activating the holders of a particular chamber doctor. The embodiment of FIG. 2 shows the use of both a working cylinder and electromagnet is for purposes of example only to illustrate different types of force elements and is not meant to limit the present invention.

The pivot point of the holder 8,19 supporting the doctor blade 5,21 is preferably disposed to prevent the ink pressure in the ink chamber 3,29 from exerting a torque on the holder 8,19 and therefore not exerting a force on or influencing the doctor blade 5,21. The sum of the torque or moment of rotation about the pivot axis of the holder 8,19 resulting from ink pressure on the doctor blade 5,21 and the holder 8,19 is zero. Furthermore, the pivot point of the holder 8,19 is preferably positioned such that the adjusting angle of the doctor blade 5,21 relative to the cylinder 1,15 will only slightly change during adjustment of the holder 8,19 to compensate for wear of the doctor blade 5,21. Pivoting movement of the working edge of the doctor blade 5,21 due to compensation adjustment takes place mainly in the adjusting direction of the doctor blade 5,21. The preferred positioning of the center of rotation of the holder applies to both a working and closing doctor blade. However, as the requirements for the closing doctor blade 22 with respect to wiping are not as exact, the center of rotation may be positioned in a different manner for ease of use and construction. The present invention may also be used for positive adjustment of the doctor blades.

The invention is not limited by the embodiments described above which are presented as examples only but can be modified in various ways within the scope of protection defined by the appended patent claims.

I claim:

1. A device for inking a cylinder having depressions for receiving ink, said device comprising:

a chamber doctor body;

an ink chamber associated with said body so as to supply ink to the cylinder;

a holder pivotally connected at a center of rotation to said chamber doctor body so that no torque is applied about the center of rotation due to ink pressure on the holder;

a doctor blade connected to said holder; and means for applying a force to said holder for causing said holder to pivot about said center of rotation and for forcing said doctor blade to contact the cylinder so as to compensate for wear of said doctor blade.

2. The device as claimed in claim 1, wherein said doctor blade and holder are connected in a stationary manner.

3. The device as claimed in claim 1, wherein said holder includes a slot and said doctor blade is positioned within said slot.

4. A device as claimed in claim 1, wherein the doctor blade is a closing doctor blade.

5. The device as claimed in claim 1, wherein said holder and said chamber doctor body are spaced by a gap and, said holder acts to seal said ink chamber at the gap.

6. The device as claimed in claim 1, further comprising means for sealing the ink chamber at a position between said holder and said chamber doctor body.

7. The device as claimed in claim 1, wherein said means for applying a force is a spring.

8. The device as claimed in claim 1, wherein said means for applying a force is a working cylinder.

9. The device as claimed in claim 1, wherein said means for applying a force is a lifting magnet.

10. The device as claimed in claim 1, wherein said force applied by said means for applying a force is adjustable.

11. The device as claimed in claim 1, wherein pivoting of said holder and a working edge of said doctor blade connected to said holder occurs in an advancing direction of said doctor blade during readjustment of said doctor blade thereby compensating for wear of said doctor blade.

12. The device as claimed in claim 1, wherein said holder is configured to hold the doctor blade so that a leading surface, as seen in a rotating direction of the cylinder, of the doctor blade forms an obtuse angle with a tangent of the cylinder.

13. The device as claimed in claim 1, wherein said doctor blade is a working doctor blade.

14. The device as claimed in claim 13, further comprising a strip; a first side wall and a second side wall; said ink chamber being bounded by said chamber doctor body, said doctor blade, said strip and said first and second side walls; said strip being positioned prior to said doctor blade along a rotating direction of the cylinder.

* * * * *